US006820818B1

(12) United States Patent
Welden

(10) Patent No.: US 6,820,818 B1
(45) Date of Patent: Nov. 23, 2004

(54) HIGH EFFICIENCY HYDRONIC HEAT SYSTEM

(76) Inventor: David P. Welden, 828 Indiana Ave., Iowa Falls, IA (US) 50126

( * ) Notice: Subject to any disclaimer, the term of this patent is extended or adjusted under 35 U.S.C. 154(b) by 0 days.

(21) Appl. No.: 10/369,284

(22) Filed: Feb. 19, 2003

(51) Int. Cl.[7] ..... F24D 3/00
(52) U.S. Cl. ..... 237/8 R; 126/360.2; 122/31.2
(58) Field of Search ..... 126/379.1, 360.1, 126/360.2; 122/15.1, 18.1, 31.1, 31.2, 379.2; 237/8 R, 8 A

(56) References Cited

U.S. PATENT DOCUMENTS 940,445 A * 11/1909 Elder ..... 126/360.2
4,768,495 A * 9/1988 Ziffer ..... 126/360.2
5,097,802 A * 3/1992 Clawson ..... 122/31.1

* cited by examiner

*Primary Examiner*—Harry B. Tanner
(74) *Attorney, Agent, or Firm*—Sturm & Fix LLP

(57) ABSTRACT

A high-efficiency hydronic heating system will make use of a direct-fired steam generator to directly heat the water in the hydronic heating system. The products of combustion, present with the steam due to the steam generator being direct-fired, are also introduced into the hydronic heating system water. Before venting the products of combustion from the packed column, heat from these products of combustion is extracted in a secondary heat exchanger to preheat the combustion air before it is used in the direct-fired steam generator. Water is a product of combustion. Over time, this excess water will overfill the hydronic heating system if it is not removed. A water dump system is used for the removal of the excess water. By measuring the water removed and the fuel used in the direct-fired steam generator, an efficiency can be calculated for visual feedback. The products of combustion will also tend to cause the water in the hydronic heating system to become acidic. Based on fuel usage, a basic substance is periodically added to the heating water to raise the PH to acceptable levels. Finally, a two-layer packed column is introduced, providing a lighter product.

29 Claims, 5 Drawing Sheets

HIGH EFFICIENCY HYDRONIC HEAT SYSTEM

BACKGROUND OF THE INVENTION

1. Field of the Invention

The present invention relates generally to a heating system. More particularly the present invention relates to a hydronic heating system using a direct-fired steam generator, two-layer packed column, secondary heat exchanger, a real-time efficiency calculation, and automatic PH control.

2. Background Art

Hydronic heating systems are commonplace in residential, commercial, and industrial buildings. Heat from the combustion of a fossil fuel is commonly transferred to the water in the hydronic heating system via conduction through fins and pipe walls, the exhaust from combustion does not come into direct contact with the heating water and is eventually vented to the atmosphere.

Another method of heating the water used in hydronic heating systems is to produce steam in a steam generator. The steam is then passed directly into the heating water which, in turn, is circulated to heat the space intended. An advantage of this latter approach is that heat can be transferred through a lesser temperature difference than the former approach. As is well known, entropy is produced by heat transfer through a finite temperature difference. Less entropy is generated when the temperature difference is reduced, and this translates into a more efficient process. However, the exhaust gases are still vented to the atmosphere, after dropping to (at best) the temperature of the return water, which is, in general, warmer than the ambient air.

When heating the water by passing steam through it, a packed column is utilized to increase the mixing of the two streams (liquid water and steam). Due to the quantity of packing material, this makes for a rather heavy boiler.

A readout, displaying efficiency or a value related to efficiency, for visual feedback, indicating a need to service a hydronic heating system would enhance the product. Unfortunately, present-day hydronic heating systems do not have such a readout.

There is, therefore, a need for a high-efficiency hydronic heating system utilizing a direct-fired steam generator for greater efficiency and with an efficiency readout. An additional need is for a packed column that is lighter than generally available, presently.

SUMMARY OF THE INVENTION

A purpose of this invention is to provide a method and apparatus for a high-efficiency hydronic heating system. To this end, a direct-fired steam generator is utilized wherein the resulting steam and the combustion products from the steam generation are all used in direct contact with the heating water. A secondary heat exchanger is used to warm incoming air used for combustion in the steam generator.

An additional purpose is for a hydronic heating system as briefly described in the preceding paragraph to have a method of eliminating excess heating water. Because the combustion products are used in direct contact with the heating water, and because water is one of the products of combustion, there will be a continuous need to remove heating water from the system. There is a need to measure this heating water removed.

Another purpose is for a visual reading of an efficiency measure for a hydronic heating system.

Still another purpose is for PH control for the water in conjunction with the direct fired steam generator method of heating the heating water in the high-efficiency hydronic heating system. Because of the presence of products of combustion in the heating water, there will be a continuous drop in the PH. This needs to be offset by the addition of a basic substance.

A final purpose is for a packed column with a reduced weight.

To improve the efficiency of a hydronic heating system, a maximum amount of heat must be removed from the combustion products. This requires that, not only should the combustion be complete, but that the products of combustion are cooled to the lowest temperature in the system. This lowest temperature is represented by the combustion air, removed from the surroundings.

To effect this heat transfer, the present invention utilizes a direct-fired steam generator. The resulting steam and the combustion products are piped into a tank containing the heating water. The steam and combustion product mixture rises through the heating water, heating the cooler return (incoming) water. The gaseous and vaporous products then continue up past a secondary heat exchanger where heat is transferred from these still-warm gaseous and vaporous products to the combustion air entering the steam generator. Thus, the products of combustion are cooled to nearly the ambient air temperature before being exhausted to the atmosphere. By returning the products of combustion to the ambient temperature within the hydronic heating system, maximum efficiency is obtained.

Because the majority of the water produced during combustion is condensed out of the combustion products, there is a continuous addition of water to the heating water supply. For this reason, water must be removed, either continuously or periodically, during operation. A water dump, for this purpose, not only eliminates the proper amount of water, it measures the quantity of water dumped. The measurement is used for calculating an efficiency of the heating system.

For visual feedback of the heating system, an efficiency is calculated. A measure of efficiency for a heating system that uses combustion for the heat required is:

$$\eta = \frac{Q_{extr}}{Q_{avail}}$$

where $Q_{extr}$ is the heat (per unit mass of fuel) actually extracted from the fuel, while $Q_{avail}$ is the higher heating value of the fuel. The amount of water condensed from the exhaust is an indirect measure of the heat extracted, $Q_{extr}$, from the fuel. The amount of water condensed is measured by the water dump system. Additionally, the higher heating value of a fuel is a constant for that fuel mixture. An effective measure of the efficiency of the present hydronic heating system, then, is:

$$\eta_e = k\frac{w_{ext}}{f_{burned}} \tag{1}$$

where $w_{ext}$ is the mass (or weight) of the water dumped, and $f_{burned}$ is the mass (or weight) of the fuel burned. A constant, k, may be used to scale the result to a desired range. An aspect of the present invention is a calculation of Eq. 1 in a programmable controller or similar calculation module, with a readout (digital or otherwise) for visual feedback of the heating system's efficiency.

Along with water, a small amount of acid is produced by the combustion process. Because of the corrosive nature of water with a low PH in a heating system, a basic substance, such as soda ash or sodium hydroxide is added to raise the PH back to an acceptable level. The amount of basic substance required is directly related to the mass of fuel burned. For the present invention, a predetermined amount of basic substance is added after a known mass of fuel has been burned.

In order to improve mixing of flows from multiple streams, such as the cooler return water and the steam with combustion products, a packed column is used. The packing causes shearing in the flows, which results in turbulent flow. Turbulent flows cause substantially greater mixing than laminar flows. The packing, however, produces a heavy column. To reduce the weight of the column while maintaining complete mixing, two layers of packing are provided: an upper layer and a lower layer.

The novel features which are believed to be characteristic of this invention, both as to its organization and method of operation together with further objectives and advantages thereto, will be better understood from the following description considered in connection with the accompanying drawings in which a presently preferred embodiment of the invention is illustrated by way of example. It is to be expressly understood however, that the drawings are for the purpose of illustration and description only and not intended as a definition of the limits of the invention.

BEST MODE FOR CARRYING OUT THE INVENTION

Figure 1:
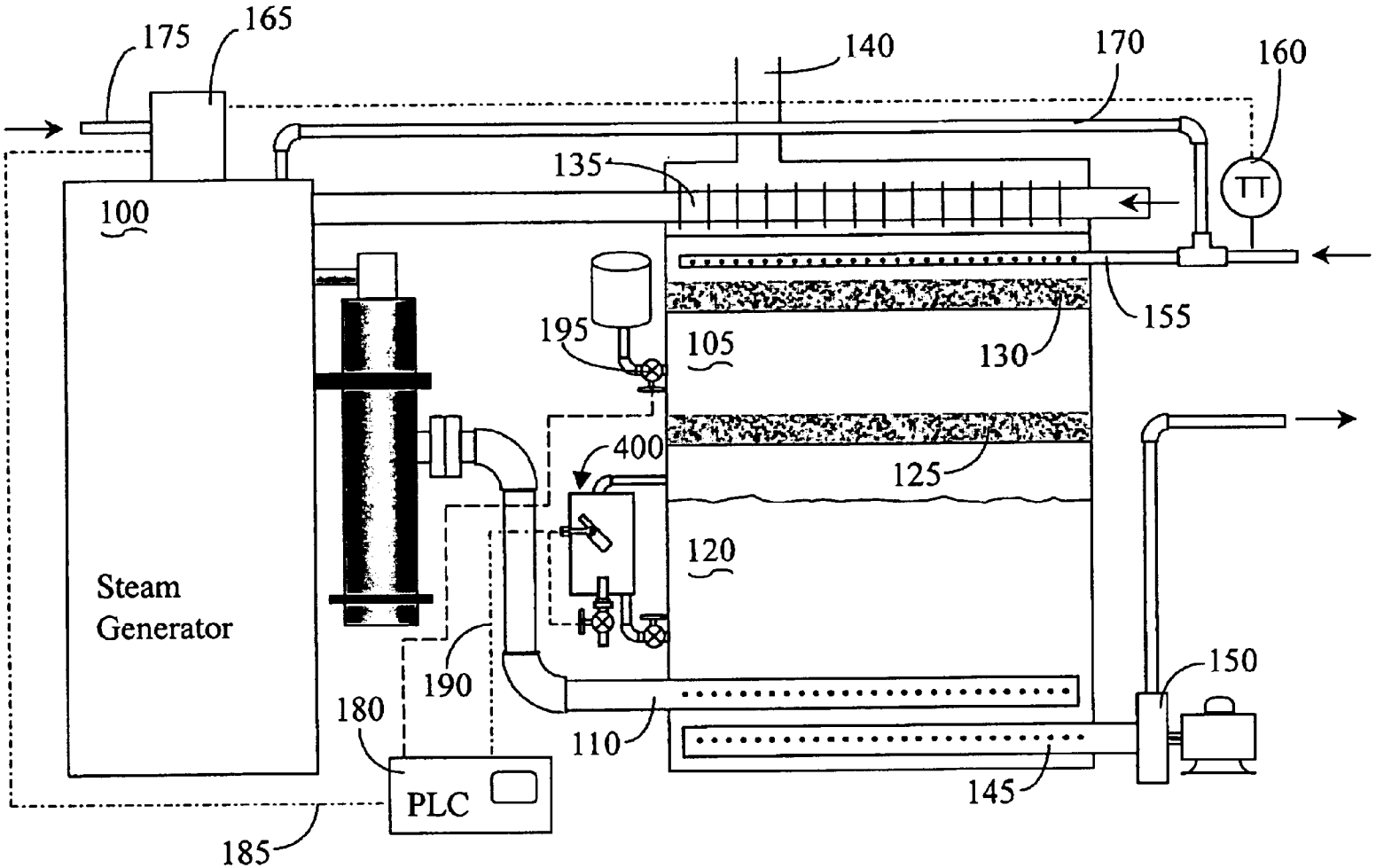
FIG. 1 shows a side elevation view of a high-efficiency hydronic heating system.

A high-efficiency hydronic heating system is shown in FIG. 1. Steam is produced in a direct-fired steam generator 100. The steam and products of combustion from the direct fired steam generator 100 are carried to a packed column 105 via a pipe 110. Inside the packed column 105, the pipe 110 is perforated with a series of holes to distribute the hot vapors throughout the pipe's length. The steam and combustion products then rise up through the liquid water 120 in the packed column 105, and through the lower packing layer 125 and upper packing layer 130 of the packed column 105. At the top of the packed column 105, the still-warm vapors pass over a fin and tube secondary heat exchanger 135 before being exhausted to the atmosphere through a stack 140. (The secondary heat exchanger need not be of fin and tube configuration.) Inside the secondary heat exchanger 135, runs combustion air for the direct-fired steam generator 100. This air is warmed by the warm vapors at the top of the packed column 105.

Hot water is pumped out of the bottom of the packed column 105 through another perforated pipe 145 by a pump 150, where it is transferred to the area or process requiring heat. After losing heat at the heating load, the water returns to still another perforated pipe 155, from which it is distributed in the packed column 105. The cooler water falls in the packed column 105 while it picks up heat, finally reentering the perforated pipe 145 where it is returned to the heating load.

The temperature of the return water in pipe 155 is measured by a temperature transmitter 160. The temperature information is transferred to a steam generator control module 165. This temperature information is used as a process variable in the control module to either turn the steam generator 100 on and off, or to modulate its output. The fuel for the steam generator 100 is also shown entering the control module 165 via line 175. Although the actual entrance may not be here, the control module 165 is directly involved with the control of the fuel, and a measurement of the fuel mass flow rate must be carried out for this present invention. The measurement of the fuel mass flow rate need not occur in the control module 165 for the present invention.

The water supply for the direct fired steam generator 100 is taken from the return water through pipe 170.

Figure 2:
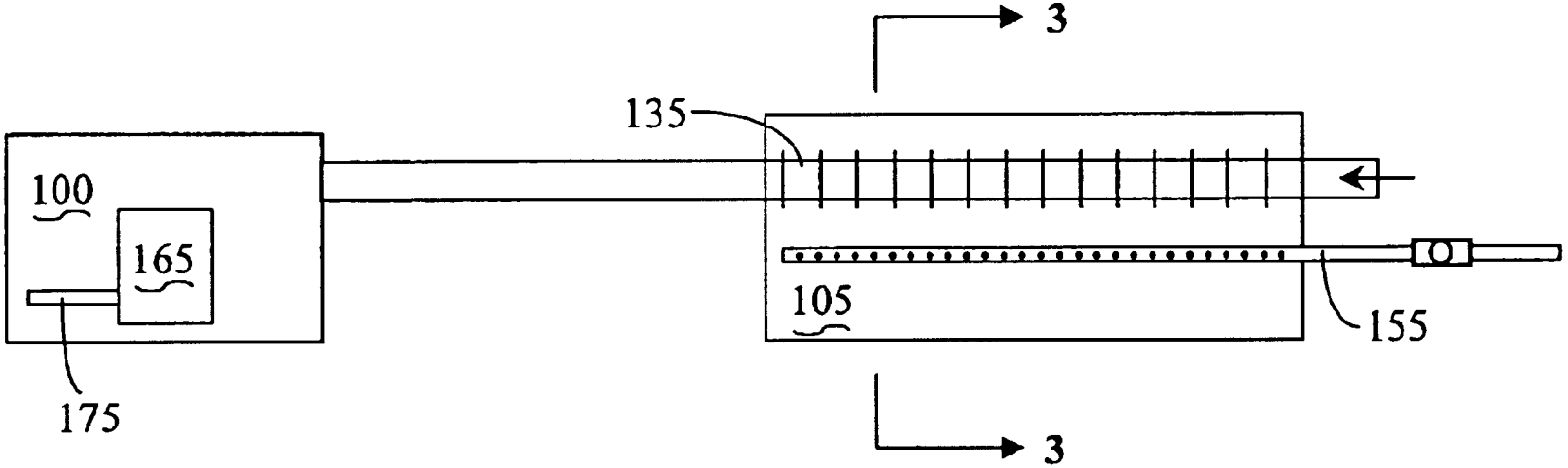
FIG. 2 shows a plan view of a high-efficiency hydronic heating system.

A plan view of the high-efficiency hydronic heating system is shown in FIG. 2. The relative locations of the pipes 135 and 155 can be seen inside the packed column 105.

Figure 3:
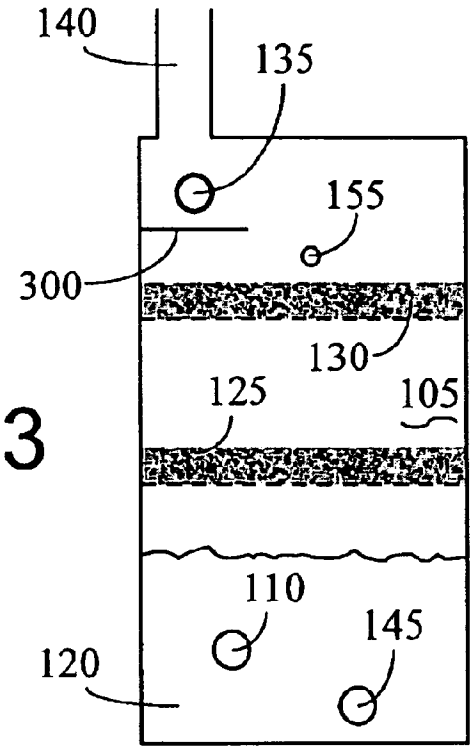
FIG. 3 shows a side elevation view of a packed column for a high-efficiency hydronic heating system.

The packed column 105 is shown from the left side of FIG. 1 in FIG. 3. A shelf or baffle 300 can be seen under the secondary heat exchanger 135 to enhance the flow of warm vapors over the secondary heat exchanger 135.

Figure 4:
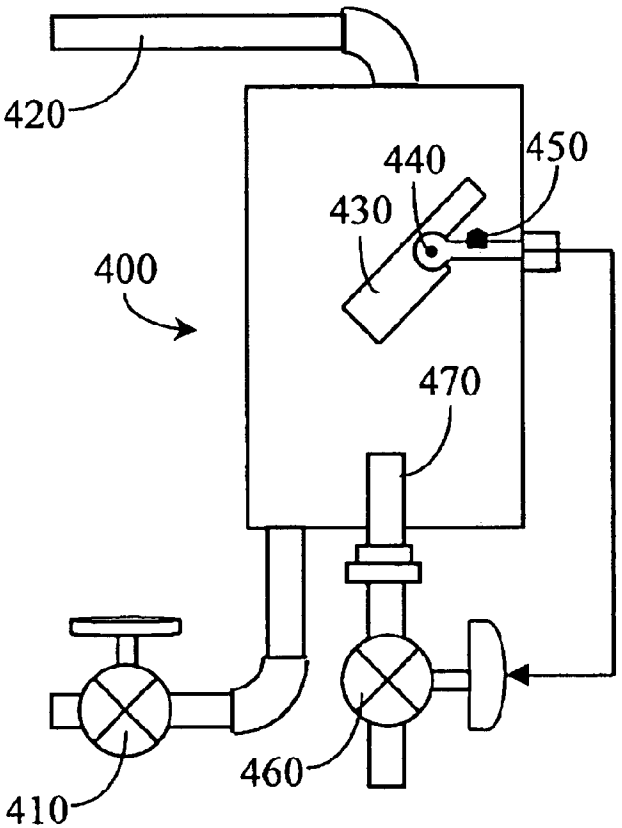
FIG. 4 shows a side elevation view of a water dump assembly.

A water-dump assembly 400, for ridding the hydronic heating system of excess water due to condensation of the water from combustion, is depicted in FIG. 4. A solenoid valve 410 is open in normal operation (thus will be a normally open valve in the preferred embodiment), as is the inlet line 420, reaching above the water level in the packed column 105. These two open lines allow the water level inside the water dump assembly 400 to match that of the packed column 105. When the water level reaches the float 430, it will cause the float to pivot on pin 440 until it contacts a switch 450. A time lag or hysteresis is built into the switch 450 and/or valve 460 such that the valve remains open until the water level reaches the top of the drain pipe 470. As long as the switch is engaged, and the circuit complete, the drain valve 460 will remain open, draining some of the water out of the hydronic heating system. Simultaneously, the solenoid valve 410 is closed so more water does not enter the dump 400 while it is dumping, thereby improving the accuracy of measurement of the dump water. The volume of water removed from the point at which the switch 450 first is engaged until the water level reaches the top of the drain pipe 470 is known. The quantity of water dumped is used in two ways:

1. After a predetermined amount of water is dumped, a basic substance will be added to the water in the hydronic heating system to raise the PH to an acceptable level.
2. The sum of the mass of water dumped over time will be divided by the integral of the fuel mass flow rate over the same time to determine an efficiency value for the hydronic heating system.

Each of these calculations and the control or indicator action resulting is carried out by a Programmable Logic Controller (PLC) 180. To this end, communications lines 185 and 190

Figure 5:
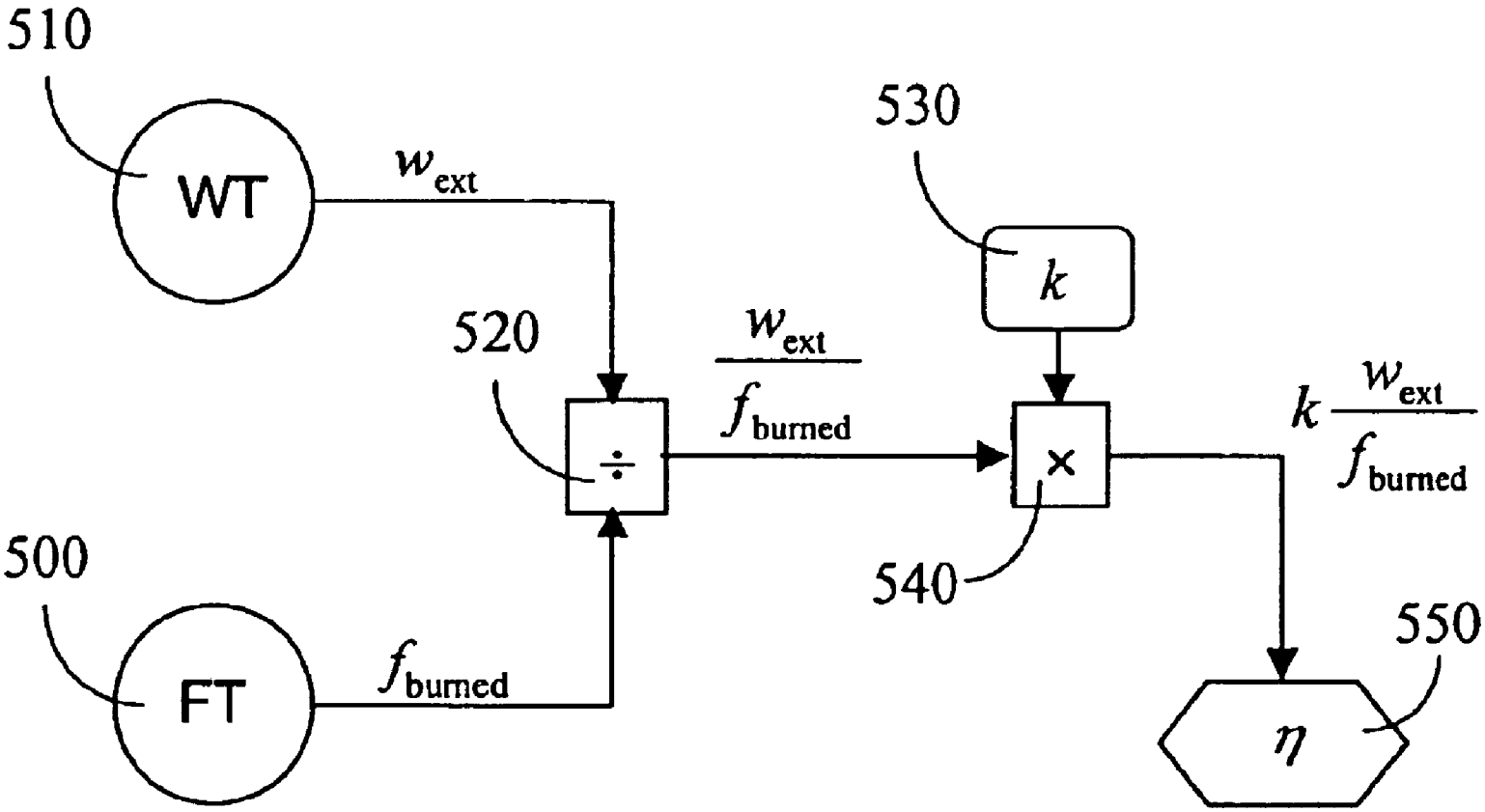
FIG. 5 depicts a first calculation module for calculating an efficiency value.

(FIG. 1) lead to the PLC from the fuel flow rate measurement in the steam generator control module 165 and the water dump switch 450. In turn, the PLC 180 controls a valve 195 permitting a basic substance such as soda ash or sodium hydroxide to be metered into the water in the hydronic heating system. The flow diagram in FIG. 5 depicts a computation module used for calculating the efficiency of the hydronic heating system using Eq. 1. A value of the mass of fuel burned 500 in the direct-fired steam generator is divided into a mass of dump water extracted 510 in division block 520. The resulting quotient is multiplied by a constant value, k 530, in multiplication block 540. This product, then, is the efficiency, η 550, desired. The constant, k 530, provides for the conversion of the numerator to a value of heat extracted from the steam and combustion products, as well as a conversion for the denominator, making it the higher heating value times the mass of fuel burned. Thus, the efficiency 550 can be scaled to always reside between 0 and 100%.

Figure 6:
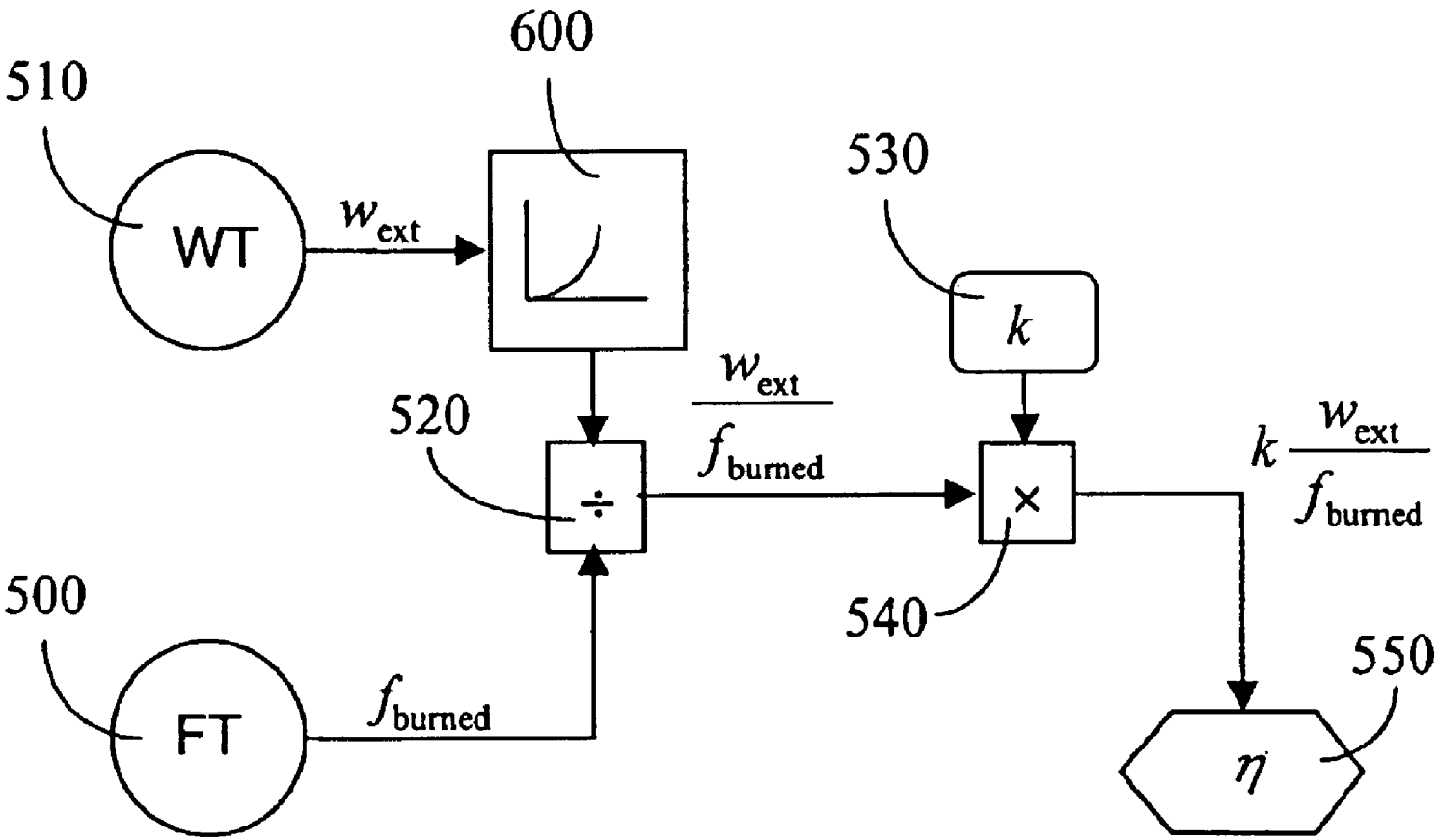
FIG. 6 depicts a second calculation module for calculating an efficiency value.

A slight modification of the flow diagram of FIG. 5 is shown in FIG. 6. Here, the mass of dump water extracted 510 ($w_{ext}$) is operated on by a function block (or table look-up) 600, where it is converted into a value proportional to the heat extracted from the steam and combustion products. If the function is significantly nonlinear, the result will be more accurate than that obtained from the calculation of FIG. 5.

The above describes the preferred embodiment, but this invention is not limited thereto. Many modifications and variations of the present invention are possible in light of the above teachings. It is, therefore, to be understood that within the scope of the appended claims, the invention may be practiced otherwise than as specifically described.

What is claimed is:

1. A method of providing for efficient hydronic heating, the method comprising:

(a) producing steam with a direct-fired steam generator; and (b) passing the steam and combustion products through water used in a hydronic heating system such that the steam and the combustion products come into direct contact with the water used in the hydronic heating system.

2. The method of claim 1 additionally comprising a water dump to discard excess water gained from the products of combustion.

3. The method of claim 2 additionally comprising the steps of:

(a) measuring a mass of the excess water that is dumped;

(b) calculating a heat extracted from the steam and combustion products based on the mass of the excess water that is dumped;

(c) measuring a mass of fuel utilized in the direct-fired steam generator;

(d) calculating a maximum possible heat extraction value based on the mass of fuel utilized in the direct-fired steam generator and a higher heating value of said fuel; and (d) calculating an efficiency by dividing the heat extracted from the steam and combustion products by the maximum possible heat extraction value.

4. The method of claim 3 wherein the step of measuring the mass of fuel utilized in the direct-fired steam generator comprises the steps of:

(a) measuring a flow rate of the fuel;

(b) calculating a mass flow rate of the fuel; and (c) integrating the mass flow rate of the fuel with respect to time.

5. The method of claim 3 wherein the step of calculating the efficiency is carried out in a programmable logic controller.

6. The method of claim 3 wherein the step of calculating a heat extracted from the steam and combustion products is carried out by multiplying the mass of the excess water that is dumped by a constant to calculate the efficiency.

7. The method of claim 3 wherein the heat extracted from the steam and combustion products is calculated using a function of the mass of the excess water that is dumped.

8. The method of claim 1 additionally comprising the steps of:

(a) measuring a fuel usage for the direct-fired steam generator; and (b) adding a basic substance to the water used in the hydronic heating system to raise the PH.

9. The method of claim 8 wherein the step of adding a basic substance to the water comprises the steps of:

(a) determining when a predetermined increment of fuel has been used in the direct-fired steam generator; and (b) adding a predetermined amount of basic substance to the water after said predetermined increment of fuel has been used.

10. The method of claim 8 wherein the basic substance is soda ash.

11. The method of claim 8 wherein the basic substance is sodium hydroxide.

12. The method of claim 1 wherein an output of the direct-fired steam generator is modulated using a temperature of return water as a process variable.

13. An apparatus for efficient hydronic heating comprising:

(a) a direct-fired steam generator for producing steam; and (b) a direct heat exchanger, utilizing the steam and combustion products in direct contact with water used in a hydronic heating system to heat said water used in the hydronic heating system.

14. The apparatus of claim 13 additionally comprising a water dump to discard excess water gained from the products of combustion.

15. The apparatus of claim 14 additionally comprising:

(a) means for measuring a mass of the excess water that is dumped;

(b) calculation means to calculate a heat extracted from the steam and combustion products based on the mass of the excess water that is dumped;

(c) means for measuring a mass of fuel utilized in the direct-fired steam generator;

(d) calculation means for calculating a maximum possible heat extraction value based on the mass of fuel utilized in the direct-fired steam generator and a higher heating value of said fuel; and (d) calculation means for calculating an efficiency by dividing the heat extracted from the steam and combustion products by the maximum possible heat extraction value.

16. The apparatus of claim 15 wherein the measuring means for measuring the mass of fuel utilized in the direct-fired steam generator comprises:

(a) means for measuring a fuel flow rate;

(b) means for calculating a mass flow rate of the fuel; and (c) means for integrating the mass flow rate of the fuel with respect to time.

17. The apparatus of claim 15 wherein the calculation means comprise a programmable logic controller.

18. The apparatus of claim 15 wherein the efficiency is calculated as the quotient of the mass of excess water and the mass of fuel burned multiplied by a constant.

19. The apparatus of claim 15 additionally comprising a computation means wherein the heat extracted from the steam and combustion products is calculated using a function of the mass of the excess water that is dumped.

20. The apparatus of claim 13 additionally comprising:

(a) means for measuring a fuel usage for the direct-fired steam generator; and (b) means for adding a basic substance to the water used in the hydronic heating system to raise the PH.

21. The apparatus of claim 20 additionally comprising:

(a) means for determining when a predetermined increment of fuel has been used in the direct-fired steam generator; and (b) means for adding a predetermined amount of basic substance to the water after said predetermined increment of fuel has been used.

22. The apparatus of claim 20 wherein the basic substance is soda ash.

23. The apparatus of claim 20 wherein the basic substance is sodium hydroxide.

24. The apparatus of claim 13 wherein an output of the direct-fired steam generator is modulated using a temperature of return water as a process variable, the apparatus additionally comprising:

(a) a temperature transmitter measuring the temperature of the return water and generating a signal based on the temperature of the return water; and (b) a steam generator control module that receives the signal based on the temperature of the return water and modulates the output of the direct-fired steam generator based on said signal.

25. A method of operating a heating system in which fuel is combusted, one product of combustion being water, the method comprising the steps of:

(a) combusting the fuel for heat;

(b) measuring a mass of liquid water produced by combusting the fuel and condensed from heat exchange with water used for hydronic heating;

(c) calculating a heat extracted from the combustion based on the mass of the liquid water produced by combusting the fuel;

(d) measuring a mass of fuel combusted;

(e) calculating a maximum possible heat extraction value based on the mass of the fuel combusted and a higher heating value of said fuel;

(f) calculating an efficiency by dividing the heat extracted from the combustion by the maximum possible heat extraction value; and (g) utilizing the efficiency to adjust an operation of the hydronic heating system.

26. The method of claim 25 wherein the step of measuring the mass of fuel combusted comprises the steps of:

(a) measuring a flow rate of the fuel;

(b) calculating a mass flow rate of the fuel; and (c) integrating the mass flow rate of the fuel with respect to time.

27. The method of claim 25 wherein the step of calculating the efficiency is carried out in a programmable logic controller.

28. The method of claim 25 wherein the step of calculating a heat extracted from the combustion products is carried out by multiplying the mass of the liquid water produced by combusting the fuel by a constant to calculate the efficiency.

29. The method of claim 25 wherein the heat extracted from the combustion is calculated using a function of the mass of the liquid water produced by combusting the fuel.

* * * * *